US008320816B2

(12) United States Patent
Bober et al.

(10) Patent No.: US 8,320,816 B2
(45) Date of Patent: Nov. 27, 2012

(54) PASS THROUGH INVERTER

(75) Inventors: Henry T Bober, Fairport, NY (US); James J Spence, Honeoye Falls, NY (US)

(73) Assignee: Xerox Corporation, Norwalk, CT (US)

( * ) Notice: Subject to any disclaimer, the term of this patent is extended or adjusted under 35 U.S.C. 154(b) by 827 days.

(21) Appl. No.: 12/211,852

(22) Filed: Sep. 17, 2008

(65) Prior Publication Data

US 2010/0067965 A1 Mar. 18, 2010

(51) Int. Cl.
*G03G 15/00* (2006.01)

(52) U.S. Cl. ..... 399/397; 399/388; 399/110; 399/401; 271/291

(58) Field of Classification Search ..... 399/397, 399/388, 407, 408, 409, 391, 110, 383, 369, 399/405, 401
See application file for complete search history.

(56) References Cited

U.S. PATENT DOCUMENTS

| | | | | |
|---|---|---|---|---|
| 4,262,895 | A | 4/1981 | Wenthe, Jr. | |
| 4,579,446 | A | 4/1986 | Fujino et al. | |
| 5,568,246 | A | 10/1996 | Keller et al. | |
| 5,720,478 | A | 2/1998 | Carter et al. | |
| 5,730,535 | A | 3/1998 | Keller et al. | |
| 5,963,770 | A | 10/1999 | Eakin | |
| 6,308,026 | B1 * | 10/2001 | Kouchi | 399/110 |
| 6,550,762 | B2 | 4/2003 | Stoll | |
| 6,612,566 | B2 | 9/2003 | Stoll | |
| 6,925,283 | B1 | 8/2005 | Mandel et al. | |
| 7,024,152 | B2 | 4/2006 | Lofthus et al. | |
| 2003/0077095 | A1 | 4/2003 | Conrow | |
| 2004/0042039 | A1 * | 3/2004 | Kodera et al. | 358/1.15 |
| 2006/0039728 | A1 | 2/2006 | DeJong et al. | |
| 2006/0039729 | A1 | 2/2006 | Mandel et al. | |
| 2006/0221159 | A1 | 10/2006 | Moore et al. | |
| 2007/0140767 | A1 * | 6/2007 | Mandel et al. | 399/381 |
| 2008/0143042 | A1 * | 6/2008 | Spence et al. | 271/225 |

OTHER PUBLICATIONS

EP Search Report; EP Application No. 09 16 9894; Date of Search May 4, 2012.

* cited by examiner

*Primary Examiner* — Matthew G Marini

(57) ABSTRACT

An improved architecture for use in a tightly integrated serial or parallel printer includes an inverter module that comprises a straight pass-through media path, as well as, an invert path. This auxiliary 'pass-through' media path of the inverter allows a sheet to enter the inverter 'backwards' through the traditional duplex exit path and continue straight out the inverter into the media path of a downstream engine to receive an image thereon.

11 Claims, 2 Drawing Sheets

PASS THROUGH INVERTER

This invention relates in general to an image forming apparatus, and more particularly, to an image forming apparatus employing a pass through inverter.

Ordinarily, a sheet inverter is referred to in the printing art as an "inverter"; its function is not necessarily limited to immediately turn the sheet over (i.e., exchange one face for the other). Its function is also to effectively reverse the sheet orientation in its direction of motion. That is, to reverse the lead edge and trail edge orientation of the sheet. Typically, in inverter devices, the sheet is driven or fed by feed rollers or other suitable sheet driving mechanisms into a sheet reversing chute as shown in U.S. Pat. No. 4,262,895. By then reversing the motion of the sheet within the chute and feeding it back out from the chute, the desired reversal of the leading and trailing edges of the sheet in the sheet path is accomplished. The position and geometry of the curved entry and exit baffles or sheet guides will accomplish the other face flipping function.

Inverters are the traditional fashion used to present the reverse side of the printed sheet for duplex printing. Inverters are also particularly useful in various systems of pre or post collation copying, for inverting the original documents, or for maintaining proper collation of the sheets. The facial orientation of the copy sheet determines whether it may be stacked in forward or reversed serial order to maintain collation. Generally, the inverter is associated with a by-pass sheet path and gate so that a sheet may selectively by-pass the inverter, to provide a choice of inversion or non-inversion. Gateless inverters are also useful as shown in U.S. Pat. No. 5,720,478. U.S. Pat. No. 5,568,246 discloses a dual mode inverter for two interconnected printers for higher productivity simplex or duplex printing with the duplex path of the second printer alternatively usable as a bypass path for the second printer. Also, plural path inverter module systems are disclosed in U.S. Pat. Nos. 4,579,446; 6,612,566 B2; 6,550,762 (FIGS. 9-11); and U.S. Pat. No. 6,925,283.

Printing systems including a plurality of image output terminals (IOTs) that can be color or monochrome are known for duplex and simplex printing and are generally referred to as tandem engine printers or cluster printing systems. See U.S. Pat. No. 5,568,246. Such systems facilitate expeditious duplex printing (both sides of a document are printed) with the first side of a document being printed by one of the IOTs and the other side of the document being printed by another so that serial printing of sequential documents can occur. The document receives a single pass through the first IOT, is inverter and then a single pass through the second IOT for printing on the second side so effectively the document receives a single pass through the system, but is duplex printed. Single pass duplex printing can be much faster than printing in a single IOT. The printers may include internal duplex loop paths for duplex printing capability in the event that the single pass duplex mode is unavailable and integrated outputs for cooperative shared printing of a print job at a higher printing rate than the capability of single IOTs. Internal duplex printing is also useful if one of the IOTs is not available for printing. For simplex printing, at least one sheet bypass or highway section extends over the second electronic printer to provide a sheet transporting path overlying the second electronic printer and bypassing the second electronic printer. Sheets from the first electronic printer are merged after leaving the sheet bypass section with sheets from the second electronic printer. Sheets conveyed in the sheet bypass section are usually conveyed at a greater speed than the printer process speed.

In tightly integrated serial or parallel printing, (i.e., a printing system that enables portions of a print job to be distributed among a plurality of marking engines, which may be horizontal or vertically stacked), long high speed media path transports are employed between upstream and downstream print engines to connect an inverter positioned between the upstream print engine and the downstream print engine with the media path transport in the down stream print engine as disclosed, for example, in FIG. 1 of U.S. Pat. No. 7,024,152 B2. Here, an extra media path or highway media path transport is employed that includes an intermediate media transport module 24 to direct sheets up and over second image output terminal 14. Serial or parallel marking engine media paths need to be able to duplex their own prints (internal duplex), do sequential duplex (single duplex), produce and exit simplex only sheets to the finisher(s) or feed fresh media to the second engine. This often involves multiple media paths or transports running the length of the printer, with selection gates, inverters, nip rolls, etc. A problem with this serial or parallel media path transport architecture is that more media paths generally increase mechanical complexity and costs, especially for unit manufacturing cost (UMC), jam clearance operability, job recovery complexity, power requirements, noise, etc.

Hence, there is a need to simplify the media path transport in tightly integrated serial or parallel printing in order to remove printer cost and mechanical complexity.

Accordingly, an improved architecture is disclosed for use in a tightly integrated serial or parallel printing system which includes at least one inverter module that comprises a straight pass-through media path, as well as, the customary by-pass and invert paths. This auxiliary 'pass-through' media path of the inverter allows a sheet to enter the inverter 'backwards' through the duplex exit path and to continue straight out the inverter without sheet reversal or image flipping into the media path of a downstream engine. The pass through inverter module architecture eliminates the need for the long high speed media transports used heretofore by making use of existing print engine media transports, thereby significantly reducing the number of new media path components needed to enable the tightly integrated serial or parallel printing architecture. Depending on the specific architecture, this could represent an approximately 30% reduction in the number of nips, length of baffling and a similar savings in drives, paper path sensors, power and ultimately UMC.

The disclosed architecture may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposers or inserters to add covers or other inserts to the compiled sets.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figures 1, 2:
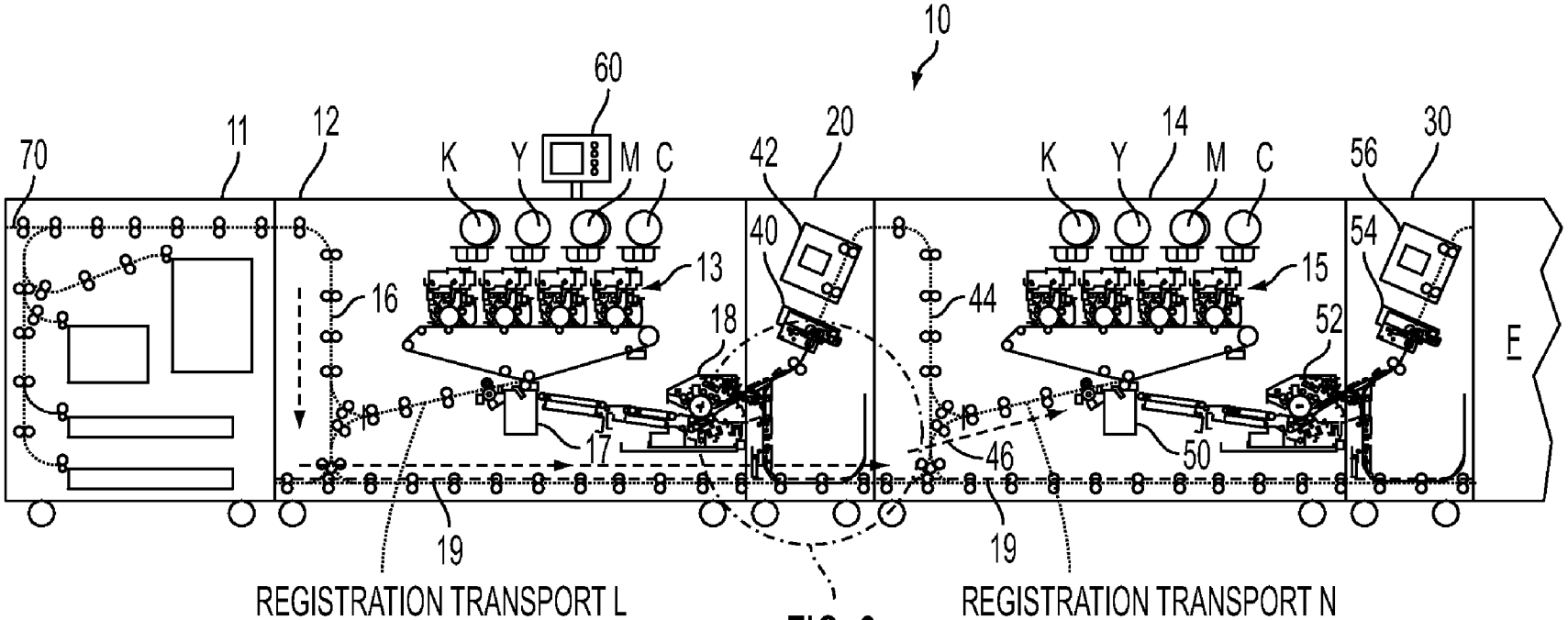
FIG. 1 is a frontal view of a tightly integrated serial printer apparatus employing a series of 'pass-through' inverter modules.
FIG. 2 is an enlarged, partial side view of one of the 'pass-through' inverter modules employed in the printer of FIG. 1.
Figure 2:
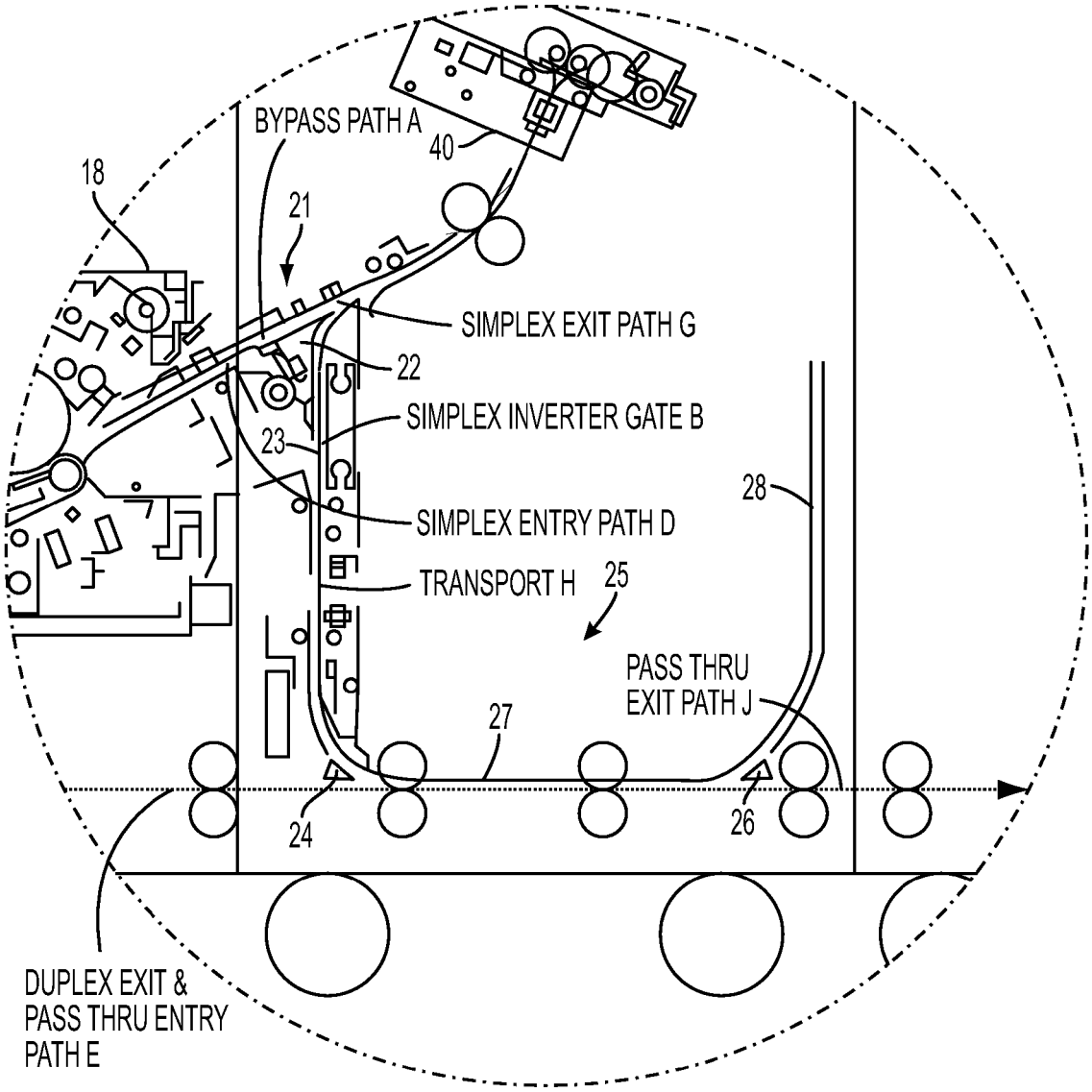

With reference to the drawings, the showing is for purposes of illustrating alternative embodiments and not for limiting same. For example, while a tightly integrated parallel printing system is described hereinafter that includes two color engines, equally useful in employing a 'pass-through' inverter would be a tightly integrated parallel printing system with two monochrome engines or one color and one monochrome engine. FIG. 1 shows a schematic view of a printing system 10 comprising a sheet feed module 11, first and second electronic printers 12 and 14 that include color image marking engines (IMEs) 13 and 15, respectively, that include cyan, yellow, magenta and black developer housings and improved inverter modules 20 and 30 connecting these three elements and associated for tightly integrated parallel printing of documents with the system. Finished output from the printing system is sent to finisher F (not shown). For simplex copies from both print engines, feeder module 11 includes a plurality of conventional sheet feeders that feed sheets downward into a vertical transport path 16 that conveys the sheets to transfer station 17 to have images from IME 13 transferred thereto. The sheets are then transported through fuser 18 and into a simplex path by-pass path A in FIG. 2 of inverter module 20 and through decurler 40 and color sensor 42. Afterwards, the sheets are transported through the vertical transport path 44 to highway media transport path 19 and into duplex exit and pass-through entry path E of inverter module 30 (which is identical in parts and functionality to inverter module 20 shown in detail in FIG. 2) with the leading edge traveling through horizontal portion 27 past gate 26 and, if needed, up into inverter leg 28 until the trailing edge of the sheet clears gate 24. The sheet is then reversed and diverted by gate 24 up inverter transport H and is diverted by gate B into simplex exit path G through decurler 54 and color sensor 56 and is delivered image face down into finisher module F. Unprinted sheets destined for the second print engine are fed from sheet feed module 11 downward through vertical transport 16 and across highway media transport path 19 entering the pass-through inverter module 20 at the pass through entry E and exiting at the pass through exit J and proceeding in the direction of arrow 46 along registration transport N to transfer station 50 to receive images from IME 15. The sheets are then transported through fuser 52, decurler 54 and color sensor 56 en route to finisher F. The details of practicing parallel simplex printing and internal or single pass (serial) duplex printing through tandemly arranged marking engines is known and can be appreciated with reference to the foregoing cited U.S. Pat. No. 5,568,246. Control station 60 allows an operator to selectively control the details of a desired job. Optionally, an insert or interposed sheet, such as, a cover, photo, tab sheet or other special sheet can be inserted into the first printer engine from an auxiliary sheet feed source (not shown) through sheet input 70, if desired. In FIG. 2 an enlarged side view of the improved inverter module 20 is positioned between the first electronic printer 12 and the second electronic printer 14 that is identical to inverter module 30 and in accordance with the present disclosure facilitates pass-through of unprinted sheets from the first electronic printer to the second electronic printer. The inverter module includes an inverter 21 with a multi-positionable simplex invert gate 22 that in a first position directs simplexed non-invert sheets (imaged on one side only) received from fuser 18 through the by-pass section A to decurler 40 and subsequently into second electronic printer 14. When gate 22 is in a second position for internal duplex purposes, sheets are directed into the entry path D down a first leg 23 of a U-shaped media path member 25 and past a duplex gate 24 that, in a retracted or first position, direct sheets through a horizontal portion 27 of U-shaped member 25 and past a pass-through gate 26 that in a first position direct the sheets up a second leg 28 of the U-shaped member until the trailing edge clears gate 24. Duplex gate 24 has now been actuated into a second position for exit to the printer's duplex path. Individual sheets are reversed and exit the duplex exit portion E of the inverter and back through highway media path 19 and registration transport L to IME 13 for imaging on the opposite side.

For serial or single pass duplexing, sheets simplexed at IME 13 enter the simplex entry path A of inverter 20 and are inverted as described hereinbefore and exit the simplex exit path G and are forwarded to IME 15 for images to be placed on their opposite sides. Afterwards, if necessary, the sheets are sent to inverter 30 to be inverted for proper orientation in finisher F.

Thus, an inverter module that includes a by-pass, simplex invert and duplex invert paths and a straight pass-through path has been disclosed that is inserted between printers in order to replace the long high speed transports that traditionally connect an upstream printer with the media path in a downstream printer. The inverter module makes use of existing printer transports to thereby significantly reduce the number of media path components needed to enable tightly integrated parallel and serial printing architectures.

Another alternative embodiment comprises a third print engine located to the right of the second print engine. In this embodiment, a third inverter module is placed to the right of the third print engine in order to properly orient sheets entering finisher F when necessary and to act as inverter for the third print engine and duplex highway path. In this embodiment, all three print engines can supply document sheets cooperatively to finisher F. Additionally, the second print engine can supply documents to the third print engine for single pass duplex printing.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An integrated printing system in which at least first and second adjacent electronic printers with outputs of printed sheets and with both simplex and duplex printing capability, including at least one of said electronic printers with an internal duplex loop path for said duplex printing capability, said first and second electronic printers having integrated outputs for cooperative shared printing of a print job, said integrated printing system including at least two modular inverter modules detachable and separate from said at least two electronic printers with one each positioned after said at least first and second electronic printers, each of said at least two inverters modules including a triple mode inverter having a pair of leg portions connected to a horizontal portion and extending upwardly from said horizontal portion to form a U-shaped portion and configured such that: in a first mode simplexed sheets are directed into and out of the triple mode inverter in a first path extending over a top portion of one of said pair of upstanding leg portions; in a second mode simplexed sheets to be duplexed are directed lead edge first into a first of said pair of upstanding leg portions of said triple mode inverter and through said horizontal portion and into the second of said pair of upstanding leg portions and then out of said horizontal portion of said triple mode inverter in reverse trail edge first and into a second path to receive images on the opposite side; and in a third mode unprinted sheets are directed through said horizontal portion in a third path to have images placed thereon by said second adjacent printer.

2. The integrated printing system of claim 1, wherein said horizontal portion of said triple mode inverter is positioned in-line with a horizontal portion of said duplex loop path.

3. The integrated printing system of claim 2, wherein said U-shaped portion of said triple mode inverter is configured to facilitate the passage of unprinted sheets into and out of only said horizontal portion of said U-shaped portion when said triple mode inverter is in said third mode.

4. The integrated printing system of claim 3, wherein said triple mode inverter includes a first gate positioned adjacent an upper end portion of one of said pair of upstanding leg portions, a second gate positioned at a point where said one of said pair of upstanding leg portions connects to said horizontal portion and a third gate positioned at a point where said the other of said pair of upstanding leg portions connects with said horizontal portion.

5. The integrated printing system of claim 3, wherein unprinted sheets enter said horizontal portion where simplexed sheets to be duplexed exit said horizontal portion en route to be imaged by said second electronic printer in said third mode of operation of said triple mode inverter.

6. The integrated printing system of claim 5, wherein said triple mode inverter directs sheets in a downward direction when in said second mode of operation.

7. The integrated printing system of claim 6, wherein said triple mode inverter includes a by-pass, simplex invert and duplex invert paths and a straight pass-through path.

8. The integrated printing system of claim 7, wherein said triple mode inverter includes a pass-through gate positioned where said first of said pair of upstanding leg portions connects to said horizontal portion and wherein said pass-through gate is open when unprinted sheets are directed from said first electronic printer to said second electronic printer to receive images thereon.

9. The integrated printing system of claim 8, wherein said pass-through gate is closed when simplexed sheets are directed in said second path for duplexing within said first electronic printer.

10. The integrated printing system of claim 1, wherein simplexed sheets are directed from said first electronic printer in said first path for duplexing within said second electronic printer.

11. A method of printing media for an integrated printing system, the method comprising:

providing a first image marking engine and a second image marking engine; said first and second image marking engines including top and bottom portions and serially arranged with one another in a first operation mode, and wherein each of said image marking engines include a developer housing located in said top portion of said first and second marking engines and a fuser for fusing images to media positioned along said bottom portion of said first and second image marking engines;

feeding media from a feed source into at least one of said first and second image marking engines during said first operation mode, said first operation mode including marking and passing of the media through said first and second marking engines; and providing an inverter apparatus including a U-shaped portion comprising two upstanding legs connected to a horizontal portion and positioned after each of said first and second image marking engines; said first marking engine includes a media highway transport positioned below and removed from said fuser and along said bottom of said first marking engine into said second marking engine; and wherein during a second mode of operation of said first marking engine said inverter apparatus allows unimaged sheets to pass through said horizontal portion thereof that is in-line with said media highway transport from said media highway transport of said first image marking engine to said second marking engine for simplex imaging.

* * * * *